US005230147A

United States Patent [19]

Asaoka et al.

[11] Patent Number: 5,230,147

[45] Date of Patent: Jul. 27, 1993

[54] ELECTRICAL HARDNESS TERMINATION APPARATUS AND METHOD

[75] Inventors: Norihiro Asaoka, Yokohama; Yoshio Ishiwata, Isehara, both of Japan

[73] Assignee: Molex Incorporated, Lisle, Ill.

[21] Appl. No.: 932,428

[22] Filed: Aug. 19, 1992

[30] Foreign Application Priority Data

Sep. 13, 1991 [JP] Japan ..... 3-262807

[51] Int. Cl.[5] ..... H01R 43/04

[52] U.S. Cl. ..... 29/861; 29/748; 29/749; 29/753; 226/113; 226/119

[58] Field of Search ..... 29/861, 748, 749, 753; 226/113, 115, 119

[56] References Cited

U.S. PATENT DOCUMENTS 4,043,494 8/1977 Bickford et al. ..... 226/109

4,333,230 6/1982 Funck et al. ..... 29/749

FOREIGN PATENT DOCUMENTS 0147081 8/1990 European Pat. Off. ..... 43/28

*Primary Examiner*—Carl E. Hall

*Attorney, Agent, or Firm*—Charles S. Cohen

[57] ABSTRACT

Right connector pieces (R) are terminated to the right ends of the cores of said insulated wires and left connector pieces (L) are terminated to the left ends of the core conductors of the insulated wires or the left ends of the insulated wires may remain unterminated. Right connector pieces each having terminals fixed thereto are displaced from an initial position to a terminating position. The right connector pieces are terminated to the right core conductor ends of the insulated wires at the terminating position. The right connector piece terminated to the right core conductor ends of said insulated wires are displaced to the initial position which results in pulling the insulated wires out of a wire supply against a resilient tension which is applied to the insulated wires for withdrawal toward said wire supply. The insulated wires are pushed down at the intermediate position between the initial-position and the terminating position to a predetermined lowest level against the resilient tension. A selected insulated wire or wires which are desired to have the longest length are held at the lowest level while allowing the other insulated wires to resiliently rise up to a predetermined second lowest level, thus measuring the second longest length of wire.

11 Claims, 16 Drawing Sheets

ELECTRICAL HARDNESS TERMINATION APPARATUS AND METHOD

FIELD OF THE INVENTION

The present invention relates to an apparatus and method for automatically terminating the terminals of an electric connector to insulated wires, and more particularly, to an apparatus and method for automatically terminating the terminals of an electric connector to one or both ends of desired lengths of insulated wire in which the lengths of selected insulated wires of a harness may be different to meet particular demands.

BACKGROUND OF THE INVENTION

An electric harness comprises a desired length of insulated wire having connector pieces terminated to one or both ends, and is used in making an electric connection between different electric apparatuses, or between an electric apparatus and associated connecting means. The lengths of insulated wires between the two ends of the electric harness depend upon the situation in which associated apparatuses are used. In this connection, an apparatus of making electric harnesses includes means for measuring a desired length of insulated wire, to one or both ends of which a connector piece or pieces are to be terminated.

One example of such length measuring means uses feed rolls to feed an insulated wire, and the length of the insulated wire can be determined in terms of the number of rotations of the feed rolls. Another example of length measuring means uses a "looper" to push down a stretched length of insulated wire to a selected low level in the form of "V", thereby determining the length of the insulated wire. The "looper" has a fixed length of up-and-down stroke.

The feed roll type length measuring means can change the length of a selected insulated wire as desired. The insulation of the insulated wire, however, may vary somewhat with the surrounding humidity or temperature. If oil or grease should make contact with the insulation of the insulated wire, the friction between the insulation and the feed roll surface will vary. The feeding length of the insulated wire will then likely vary due to slippage between the insulation and the feed roll surface. As a result, the length of the measured wire may be shorter than the desired length, and the harness having such a shorter insulated wire will be rejected.

As for the "looper" type length measuring means, its "looper" is designed to be raised and lowered a predetermined distance, and therefore, it cannot measure different lengths of insulated wires. Changes to the length of the wires can be achieved by mechanically altering the looper, but such changes can be time consuming. Accordingly the use of "harnesses" made by such "looper" type systems is limited.

SUMMARY OF THE INVENTION

In view of the above, one object of the present invention is to provide a method of automatically measuring and cutting desired lengths of insulated wire with accuracy and terminating terminals of the connector pieces to one or both ends of the desired lengths of insulated wire.

Another object of the present invention is to provide an apparatus for automatically measuring and cutting desired lengths of insulated wire with accuracy and terminating terminals of connector pieces to one or both ends of the desired lengths of insulated wire.

According to the present invention, terminals of connector pieces are terminated to one ends of all insulated wires simultaneously; selected insulated wires are measured to provide the insulated wires of the desired length; and finally terminals of connector pieces are terminated to the other ends of the desired lengths of insulated wire simultaneously.

A method is provided of automatically terminating terminals of connector pieces to insulated wires in which a plurality of insulated wires of desired lengths are prepared; terminals at one end of the harness to be prepared are terminated to the adjacent ends of the insulated wires; and terminals at the other end are terminated to the other end of the insulated wires, or the other ends of said insulated wires remain unterminated.

An apparatus for automatically terminating terminals of connector pieces to insulated wires is also disclosed that includes measuring means for measuring desired lengths of insulated wires, and terminating means for terminating right terminal connector pieces to the right core conductor ends of said insulated wires, and cutting said desired lengths of insulated wires and terminating left connector pieces to the left core conductor ends of said desired lengths of insulated wires to remain free of terminal connector pieces. The present invention also includes transferring means for transferring right terminal connector pieces each having a terminal fixed thereto from initial position to terminating position, and transferring said right terminal connector pieces back to said initial position after said terminations means has terminated said right terminal connector pieces to the right core conductor ends of said insulated wires. Wire supplying means is provided responsive to the pulling of said insulated wire for unwinding the insulated wire, yet still applying a constant tension to pull back the insulated wires having right terminal connector pieces terminated thereto. Measuring means push down said insulated wires against the wires at an intermediate position between the terminating position and said initial position to predetermined lower levels corresponding to the desired lengths of the insulated wires between their opposite terminal connector pieces. Clamp mechanisms are utilized to clamp the insulated wires on the wire supplying side to keep the insulated wires at desired predetermined lower levels. A lift mechanism for raising the left connector pieces to said terminating position whereby after all of the insulated wires are pushed down to the lowest position, a selected insulated wire or wires may be kept at the lowest position by said clamping means and allowing the other insulated wires to follow the measuring means as it rises due to the influence of the constant tension. This measuring procedure may be repeated until all the desired lengths have been set.

BRIEF DESCRIPTION OF THE DRAWINGS

Other objects and advantages of the present invention may be understood from the following description of preferred embodiment of the present invention, which is shown in accompanying drawings in which.

DETAILED DESCRIPTION OF THE PREFERRED EMBODIMENT

Figure 1:
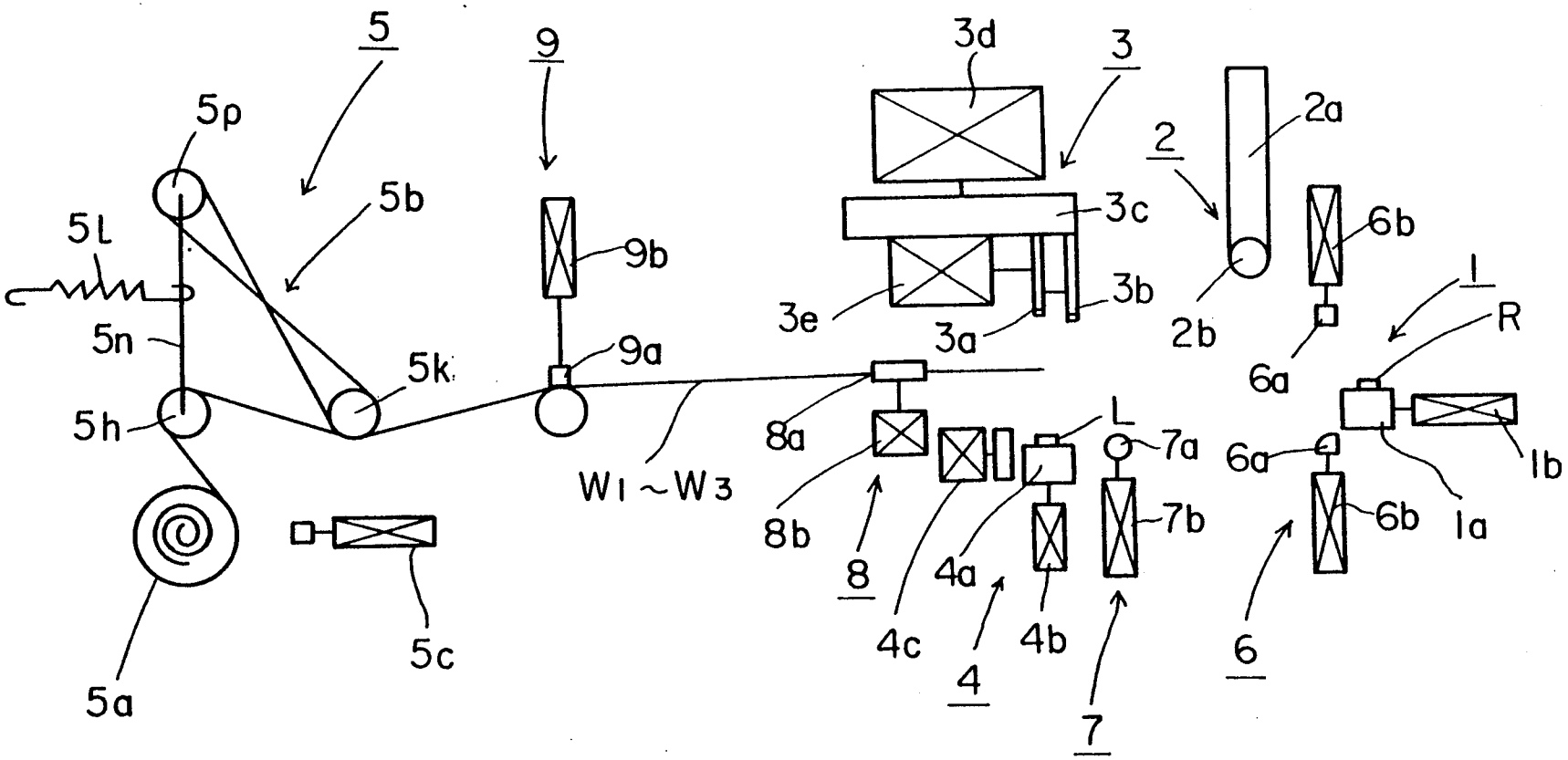
FIG. 1 is a diagrammatical view of a harness forming apparatus of the present invention showing the apparatus in its initial position.

FIG. 1 diagrammatically shows an apparatus of the present invention for automatically measuring desired lengths of insulated wires and terminating electrical connector pieces to the ends of such desired lengths of insulated wires. It comprises a transporting unit 1 for transporting right connector pieces R, a wire measuring unit 2, a termination unit 3, a connector lift 4 just below the termination unit 3, and wire feeding unit 5. These units are arranged from right to left in the order named. A wire clamper 6 is located between the transporting unit 1 and the wire measuring unit 2. An auxiliary support mechanism 7 for supporting insulated wires while being measured is located between the wire measuring unit 2 and the connector lift 4. A wire lift 8 and a wire clamper 9 are located between the connector lift 4 and the wire supplying unit 5.

The connector transporting unit includes a carriage 1*a* for carrying connector pieces R each having at least one terminal fixed thereto, and a pneumatic piston-and-cylinder 1*b* for driving the carriage 1*a*. The connector transporting unit receives a single or plurality of connector pieces R to carry and located under the termination unit 3. Then, each terminal is terminated to one end of each insulated wire. Thereafter, the connector transporting unit carries the connector piece R and insulated wires back to the initial position. The carriage 1*a* is known per se, and may be any conventional structure so far as it may be appropriate for the purpose. An apparatus for supplying right connector pieces R to the carriage 1*a* may be any conventional structure which is capable of supplying connectors of different circuit sizes. This unit may be designed for supplying connector pieces one after another on demand. When right terminal connector pieces R are supplied to the carriage 1*a*, these pieces are arranged in a direction perpendicular to the plane shown in FIG. 1.

The wire measuring unit 2 comprises a roll lifting member 2*a* and a roll 2*b* rotatably attached to the lower end of the roll lifting member 2*a*. The wire measuring unit 2 can be put in operation when the connector transporting unit 1 brings the right connector pieces R back to the initial starting position after they have been terminated to the ends of the insulated wires. The roll 2*b* is lowered to contact the insulated wires at a location intermediate terminating unit 3 and wire clamp 6 in order to push the wires down to a predetermined lowest position. It is then raised a predetermined distance to allow some selected insulated wires to rise to a predetermined second lowest position, leaving the other insulated wires to remain at the lowest position. This occurs because all of the insulated wires are subjected to tension which tends to pull back the insulated wires towards the wire supplying unit 5. The selected insulated wires that are pulled rearward under tension follow the rising roll 2*a* whereas the other wires are held stationary by clamp 9. In order to obtain wires of still shorter length, the roll 2*b* is raised another predetermined distance to permit some of the previously selected insulated wires to rise to a predetermined third lowest position while the other insulated wires of the first selected ones remain at the second lowest position. Thus, the insulated wires retained at the second lowest position are the second longest ones and those retained at the third lowest position are the third longest ones. It can be seen that more than three different lengths of wires can be achieved by clamping the wires as desired as the roll 2b is raised.

Figure 29:
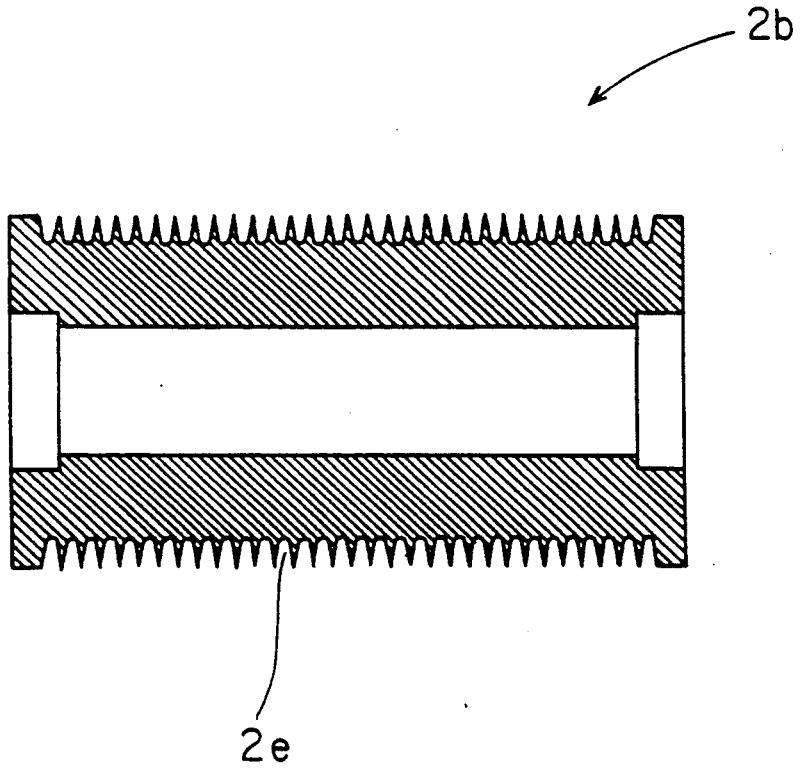
FIG. 29 is a longitudinal section of the roll of the wire measuring unit, taken along the line 29—29 in FIG. 28.

One example of the wire measuring unit 2 is shown in more detail in FIGS. 26–29. It comprises a vertical rail 2c, a roll lift 2a slidably mounted on rail 2c that rises and descends along the rail 2c under the control of an associated robot using a servomotor and a roll 2b rotatably mounted to the end of the roll lift 2a as indicated at 2d. The roll 2b has a plurality of grooves 2e at regular intervals on its circumference (FIG. 29).

The termination unit 3 includes a right termination tool 3a to terminate to the right conductor ends (as viewed in FIGS. 1–19) of the insulated wires the right connector pieces R which are brought to the termination station by the carriage 1a, a left cutting and termination tool 3b to cut the insulated wires at their left ends and terminate them to the left connector pieces L which are brought to the termination station by the left connector lift 4, a pneumatic piston and cylinder 3e to move the right termination tool 3a and the left cutting and terminating tool 3b back and forth, and a vertically movable base 3c driven by an associated pneumatic piston and cylinder 3d. The right termination tool 3a, the left cutting and terminating tool 3b and the pneumatic piston and cylinder 3e are mounted at the bottom of movable base 3c.

Each termination tool has a plurality of termination units of known type spaced at regular intervals. Each termination unit functions to put the end of an insulated wire in the slot defined by the terminal of a connector piece, and forces the end of the insulated wire into the terminal until its opposite piercing projections thrust through the insulation of the insulated wire to contact the core conductor of the insulated wire and thus making the required electric contact.

The connector lift 4 comprises a nest 4a to contain left connector pieces L, each having at least one terminal to be connected to the left end of an insulated wire, and a pneumatic piston and cylinder 4b to raise and lower the nest 4a. In the preferred embodiment, the connector lift is equipped with a horizontally movable pneumatic piston and cylinder 4c to hold the nest 4a at its raised position when the pneumatic piston and cylinder 4b raises the nest 4a up to the termination station. Left connector pieces L can be supplied to the nest 4a from a conventional connector piece supply (not shown). It may be of any conventional structure which is capable of supplying a desired number of left connector pieces L of same or different number of circuits.

Figure 22:
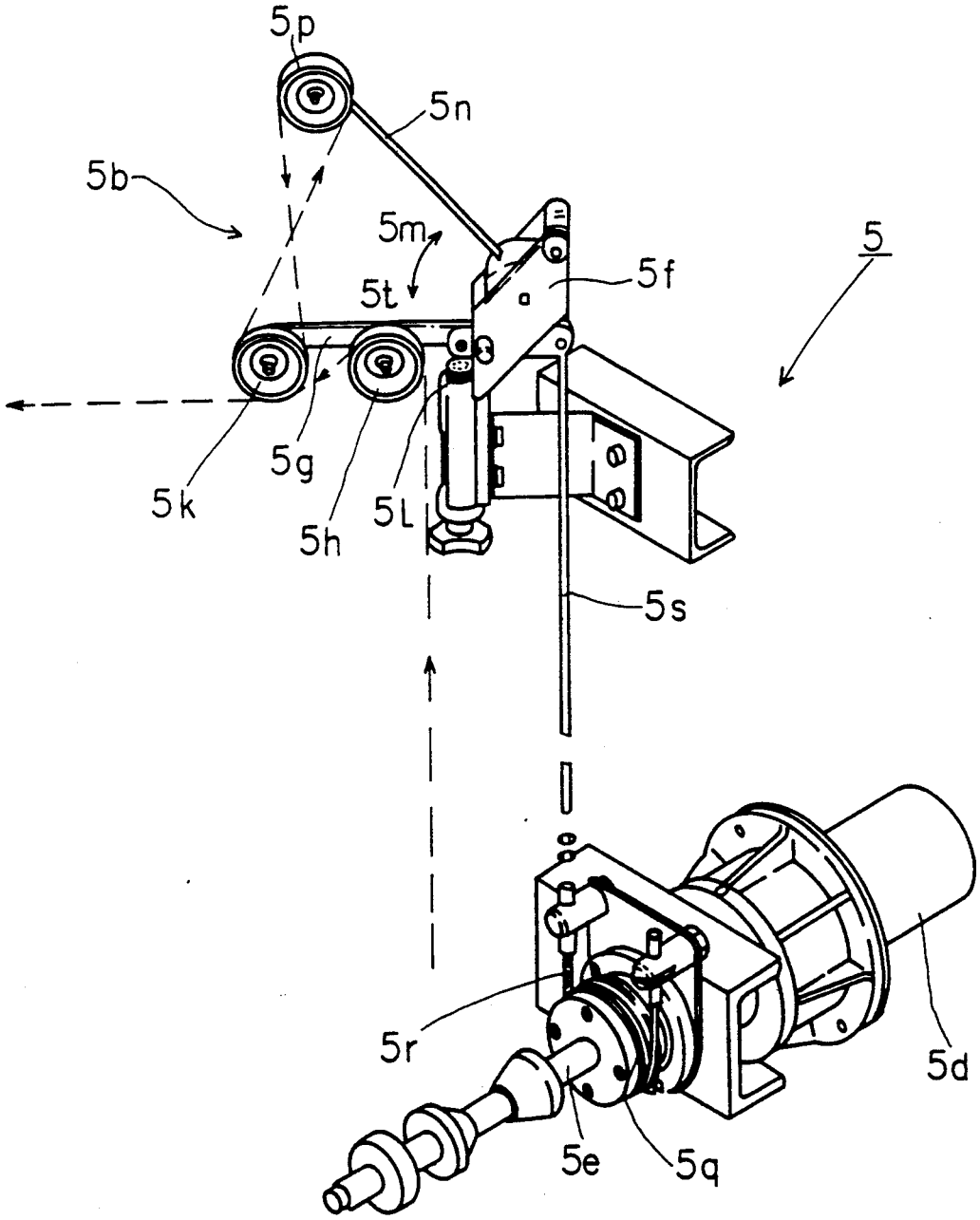
FIG. 22 is a perspective view showing a wire feeding unit.

The wire supplying unit 5 consists of as many sub-units as the number of insulated wires to be handled. Each sub-unit includes a wire-feeding reel 5a and a wire-retaining assembly 5b as shown in FIG. 22. The wirefeeding reel 5a is fixed to the end of shaft 5e of an electric motor 5d. The wire retaining means 5b includes a stationary base frame 5f having a lateral stationary arm 5g and an inclined movable arm 5n, two guide rolls 5h and 5k rotatably mounted to the lateral arm 5g, and a guide roll 5p rotatably mounted to the free end of the inclined movable arm 5n. The inclined movable arm 5n is spring biased toward its full open position by a spring 5L. A brake drum 5q is fixed to the shaft 5e of the electric motor 5d, and a brake band 5r winds around the brake drum 5q. One end of the brake band 5r is connected to a rod 5s, which is operatively connected to the inclined movable arm 5n via a cam member (not shown).

The insulated wire is coiled around the wirefeeding reel 5a and then runs to guide roller 5h guide roller 5k, guide roller 5p and back to guide roller 5k, in the order named, and then towards the termination unit 3. When the insulated wire is not pulled by the wire measuring unit 2, the spring-biased arm 5n is at its position furthest from lateral stationary arm 5g as indicated at 5m, with the guide roll 5p positioned furthest from the guide roll 5k. Through such a structure with the wire running therethrough, a length of the insulated wire is retained which can be fed to the downstream units without feeding from reel 5a. In this condition, the brake band 5r is tightly wound around the brake drum 5q to stop the rotation of the shaft 5e of the electric motor 5d, thus preventing the feeding of the insulated wire from the wire-feeding reel 5a.

When a pulling force is applied to the insulated wire to overcome the counterforce generated by the spring 5l, the spring-biased arm 5n is pulled towards its closed position as indicated at 5t to feed the insulated wire. Then, the rod 5s is actuated through the action of the cam (not shown) to loosen the brake band 5r, thereby permitting the shaft 5e of the electric motor to rotate and feed a sufficient length of insulated wire to allow the spring biased arm 5n to return to its position as indicated at 5m. Thus, a predetermined length of insulated wire is retained in the geometric structure 5b.

The wire-feeding system just described is of a positive wire-feeding type in which the electric motor rotates the wire-feeding roll 5a to feed the insulated wire. Alternatively, use may be made of a wire-feeding system which is designed to be responsive to the pulling of the insulated wire by wire measuring unit 2. In this case. the wire-feeding system omits the motor 5d, the brake 5g and rod 5s and replaces them with a pneumatic piston and cylinder 5c, as seen from FIGS. 1 to 19. Otherwise, wire-retaining assembly 5b remains substantially unchanged. Such a modified wire-feeding system utilizes spring 5L to pull the insulated wire back upstream (i.e., in a direction which is opposite to the wire feeding direction). In addition, insulated wire is only fed when the insulated wire is pulled toward the termination station by a force which is strong enough to overcome spring 5L.

The wire clamper 6 on the right side of FIGS. 1–19 functions to clamp a plurality of insulated wires to avoid stress being placed on the terminations while the wires are engaged and pulled by measuring unit 2. As shown in FIG. 1, it comprises upper and lower assemblies, each having a pusher 6a and a pneumatic piston-and-cylinder 6b.

The auxiliary support mechanism 7 is positioned between the wire-measuring unit 2 and the termination unit 3. It includes a support plate 7a and a pneumatic piston-and-cylinder 7b. After the right connector pieces R are terminated to the ends of the insulated wires W1 to W3 and after the connector piece R is returned to its initial position by the carriage 1a, desired different lengths of insulated wires are measured as previously described with respect to wire measuring unit 2. During such measuring operation, the auxiliary support mechanism 7 functions to support all or selected ones of the insulated wires until left connector pieces L have been terminated to the left ends of the insulated wires.

The wire lift 8 includes a wire gripper 8*a* and a piston-and-cylinder 5*b* to raise and lower the wire gripper 8*a*. After the right connector pieces R are brought to the terminating position by the carriage 1*a*, and just prior to termination thereof, the wire lift 8 lowers the right ends of the insulated wires to the appropriate level to permit the right connector pieces R to be terminated to the right ends of the insulated wires and hold all of the insulated wires at such a level until the right and left connector pieces have both been terminated to the respective ends of desired lengths of insulated wire.

The wire clamper 9 on the wire-feeding side functions to clamp selectively the insulated wires. It includes a pusher 9*a* and a pneumatic piston-and-cylinder 9*b*. The wire clamper 9 serves two functions. First, it clamps and holds the insulated wires at the appropriate level for terminating the connector pieces to the insulated wire. Second, clamping and unclamping selected insulated wires in conjunction with the operation of the wire measuring unit 2 facilitates the construction of the desired harnesses having different length wires.

Figure 23:
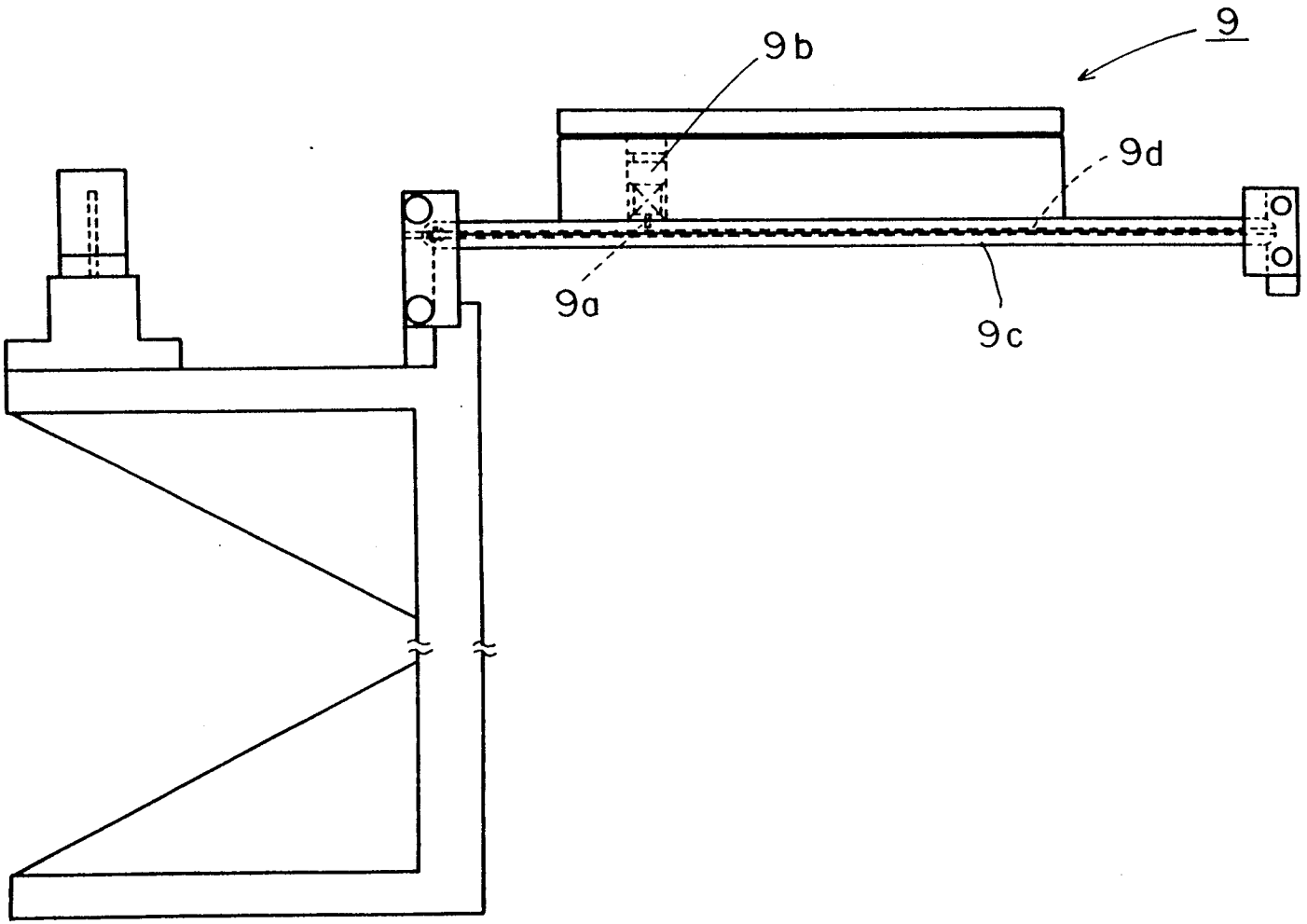
FIG. 23 is a side view of a wire clamping unit located on the wire-feeding side.
Figure 24:
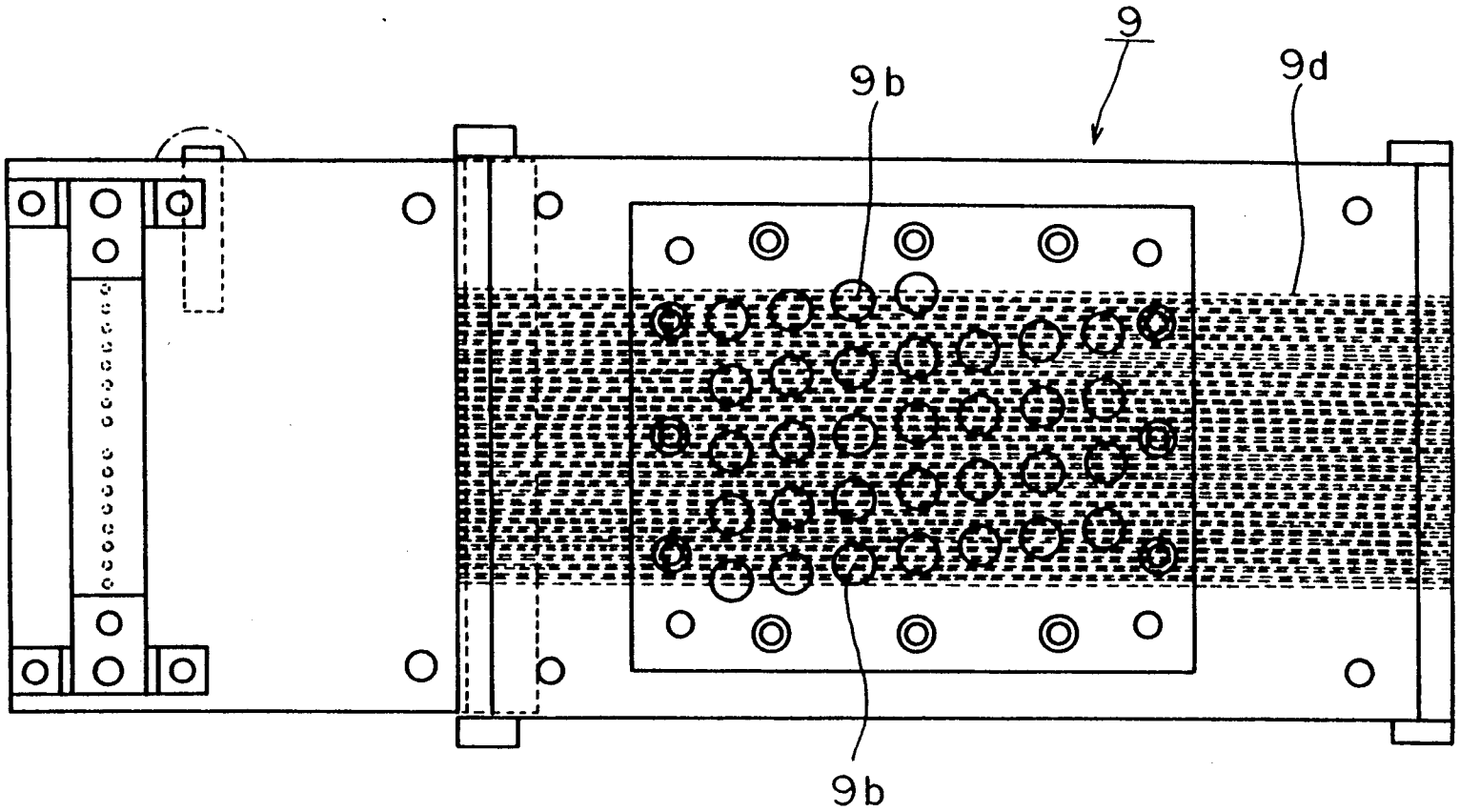
FIG. 24 is a plan view of the wire clamping unit of FIG. 23.
Figure 25:
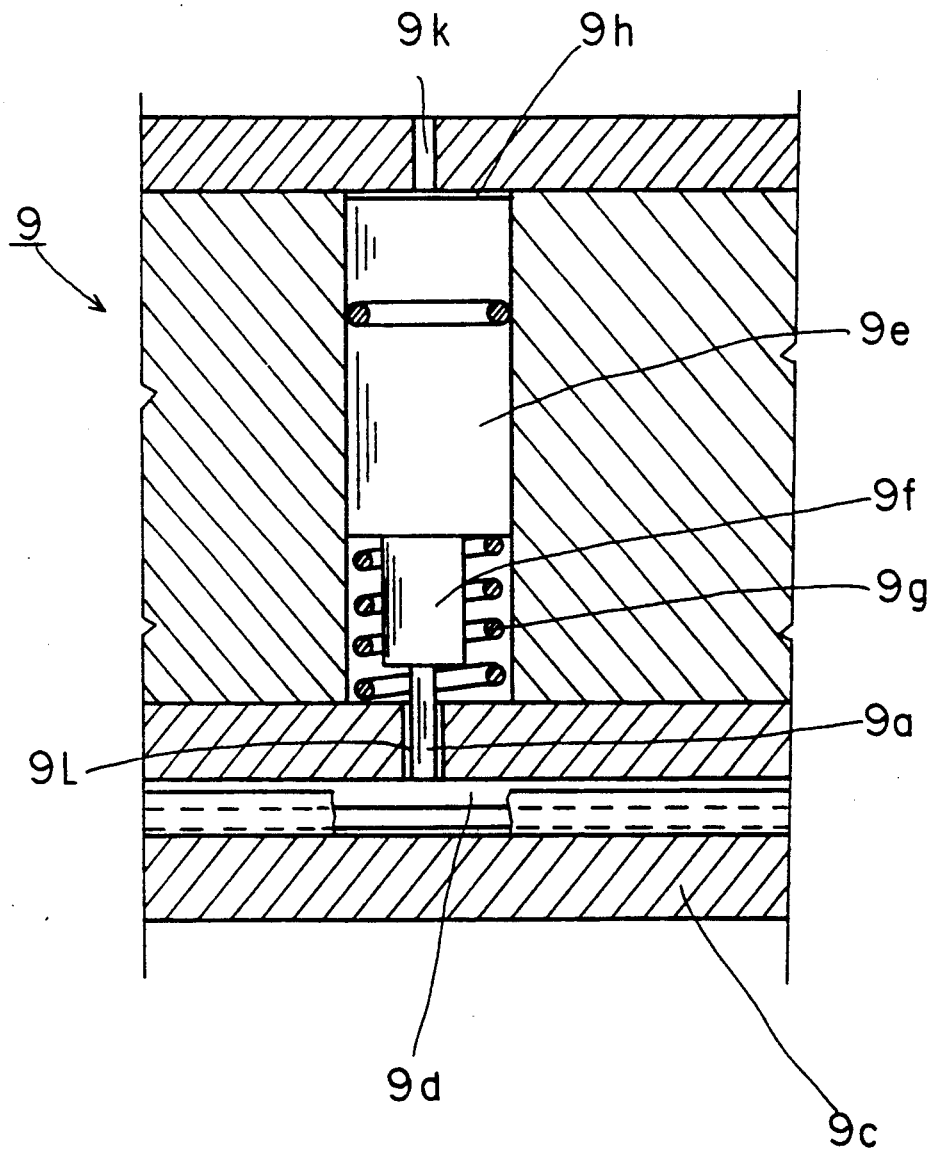
FIG. 25 is a vertical section showing a pneumatic piston-and-cylinder assembly in the wire clamping unit.
Figure 26:
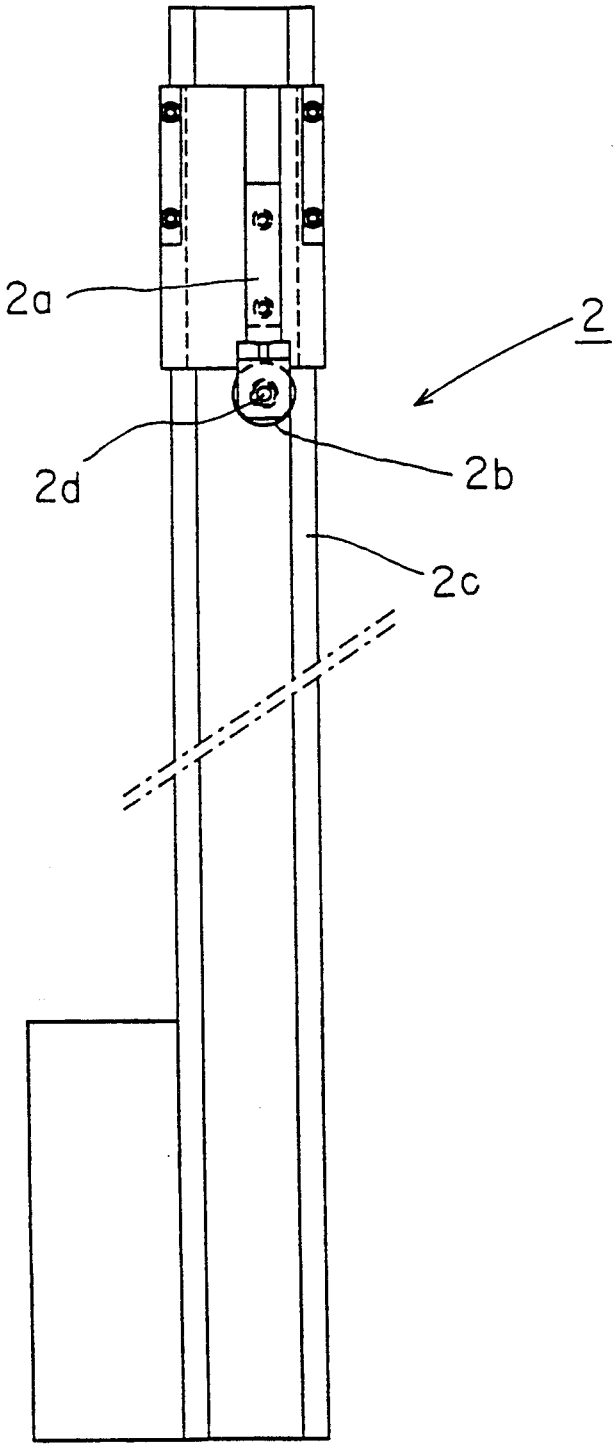
FIG. 26 is a side view of a wire measuring unit or looper.
Figure 27:
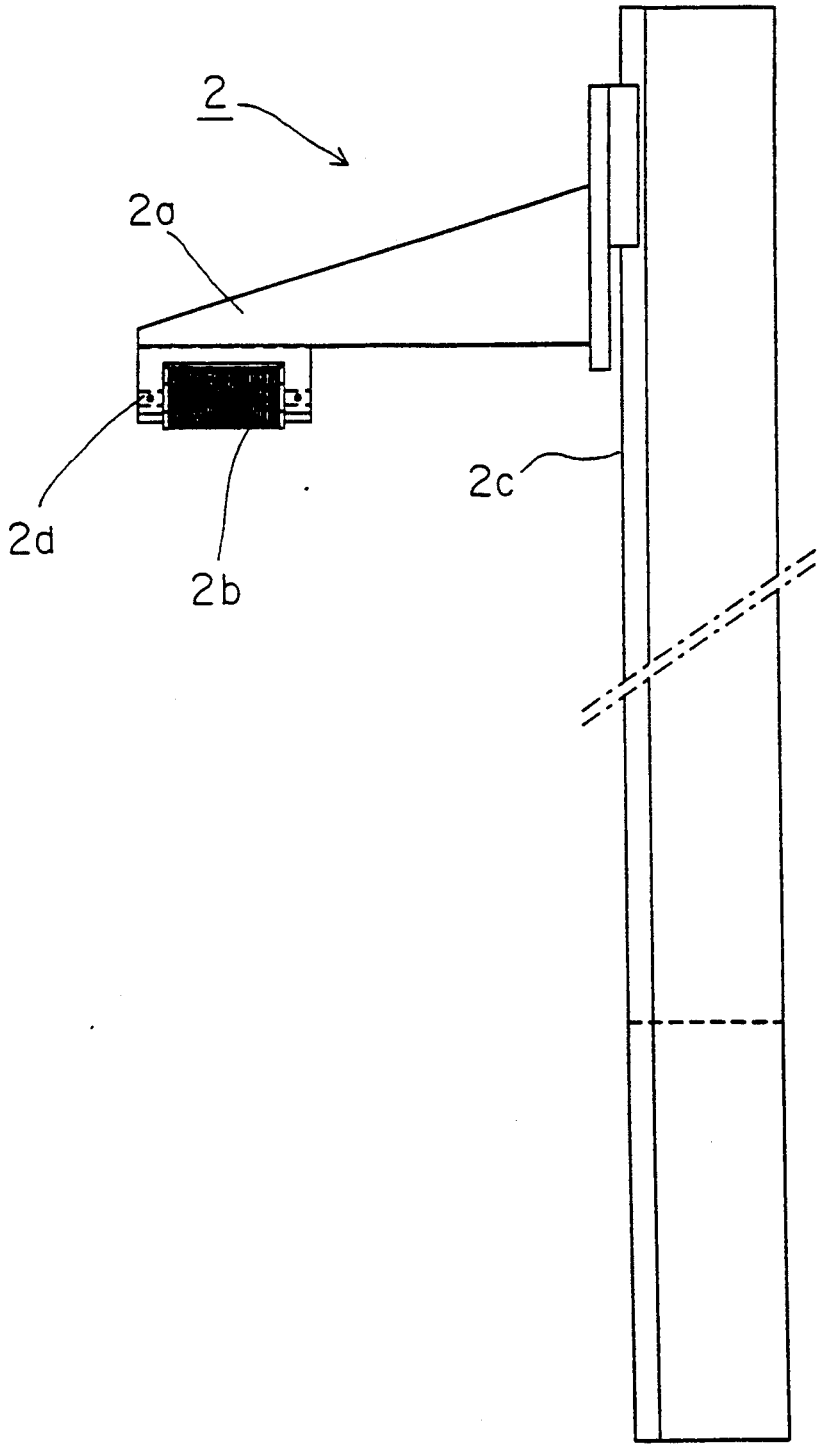
FIG. 27 is a front view of the wire measuring unit of FIG. 26.
Figure 28:
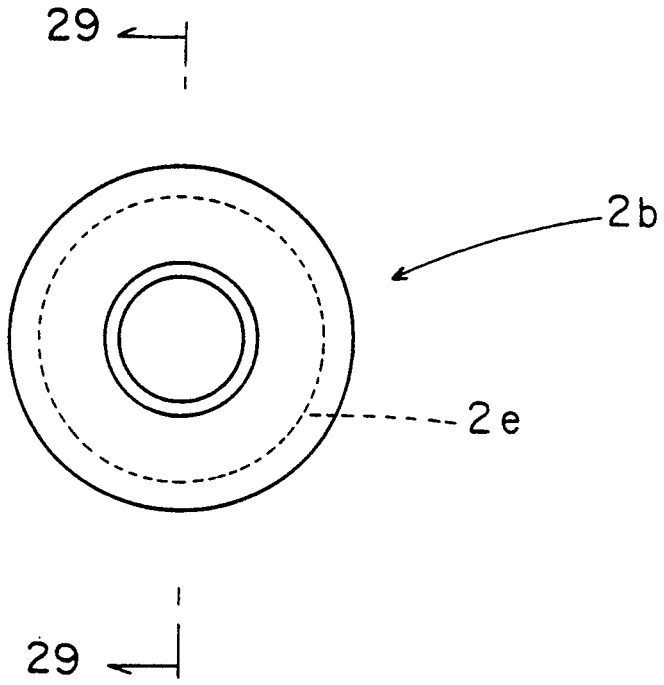
FIG. 28 is a side view of the roll of the wire measuring unit.

One example of the wire clamper 9 is shown in FIGS. 23, 24 and 25. A plate 9*c* of the wire clamper 9 has as many parallel grooves 9*d* as the number of insulated wires to be handled. A pneumatic piston-and-cylinder 9*b* is positioned above each of these grooves 9*d*. One example of the pneumatic piston-and-cylinder 9*b* is shown in FIG. 25. The piston includes an integration of a relatively large diameter portion 9*e*, a relatively small diameter portion 9*f*, a pin-like clamping tip 9*a*, and a coiled spring 9*g* around the relatively small diameter portion 9*f* to push up the integration, thereby biasing the clamping tip 9*a* away from the underlying insulated wire. An inlet aperture 9*k* is made to permit the introduction of compressed air to the upper end surface of the piston whereas an aperture 9L permits the clamping tip 9*a* to project into the groove 9*d*.

Figure 20:
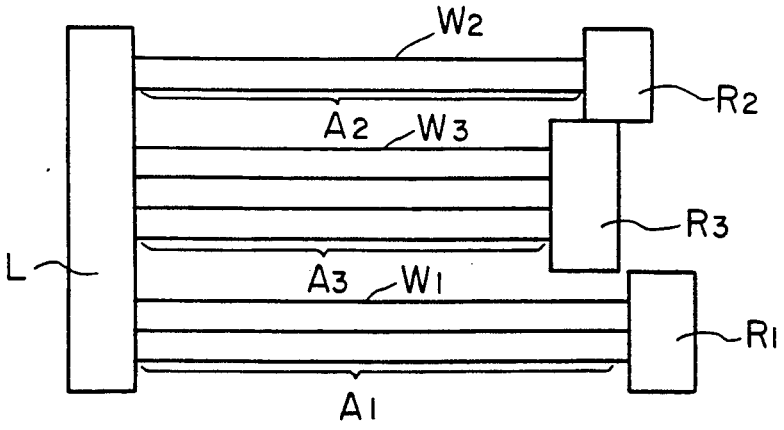
FIG. 20 shows schematically one example of harness comprising a plurality of insulated wires of different lengths with connector pieces terminated to both ends of the insulated wires.

FIG. 20 shows a harness having nine insulated wires in which a two-circuit connector piece R2 is terminated to the right ends of two insulated wires W2 of predetermined length A2, a four-circuit connector piece R3 is terminated to the right ends of four insulated wires W3 of predetermined length A3, a three-circuit connector piece R1 is terminated to the right ends of three insulated wires W1 of predetermined length A1, and a nine-circuit connector piece L terminated to the right ends of nine insulated wires W1, W2 and W3 of predetermined lengths A1, A2 and A3 (A1>A2>A3).

Referring to FIGS. 1 to 19, a series of automatic measuring and terminating operations are described below. In FIGS. 2 to 19, reference numerals have been added to selected parts and units which are referred to in the description of the operation pertaining to each of these drawings. The right connector pieces R1, R2 and R3 are arranged in line perpendicular to the plane in which the drawing is laid, and are collectively indicated by R.

FIG. 1 shows the initial position of the measuring-and-terminating apparatus in its initial position after the harnesses formed in the preceding cycle have been removed and the apparatus is ready to start the subsequent cycle. All of the insulated wires are raised by the wire lift 8, and the right ends of the insulated wires are in their horizontal termination position.

Figure 2:
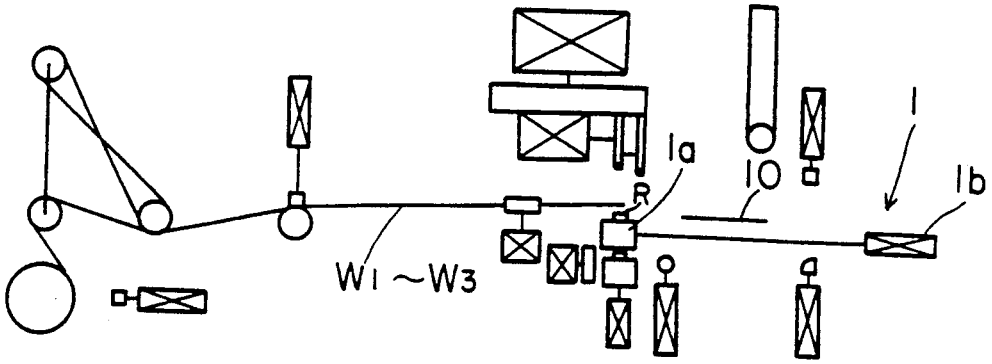
FIG. 2 is similar to FIG. 1, but shows the apparatus in which the terminals of the "right" connector piece are transported to the termination station.

FIG. 2 shows that the pneumatic piston-and-cylinder drive 1*b* has driven the carriage 1*a* to the termination station as indicated by 10, thus transporting the right connector pieces R, which are contained in the nest of the carriage 1*a*, to the termination station.

Figure 3:
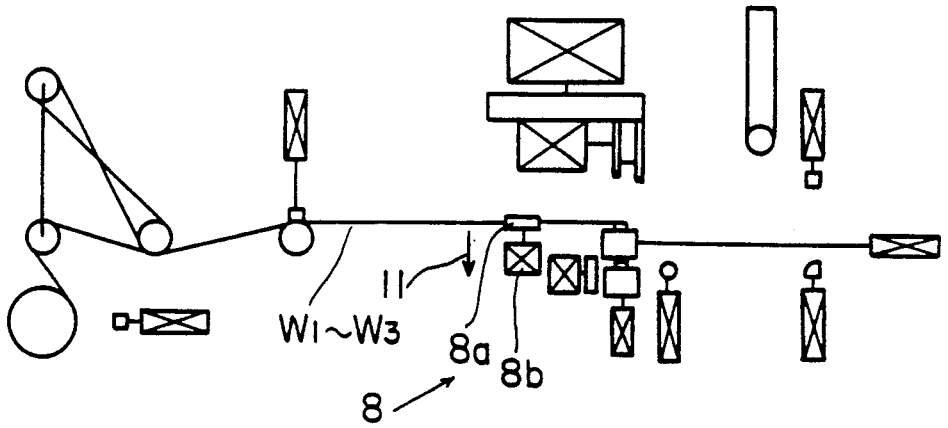
FIG. 3 is similar to FIG. 2, but shows the lift mechanism in a lowered position to put the right ends of the insulated wires in termination position.

Next, FIG. 3 shows that the pneumatic piston-and-cylinder drive 8*b* of the wire lift 8 lowers the wire gripper 8*a* all of the insulated wires W1, W2 and W3 in the proper vertical position.

Figure 4:
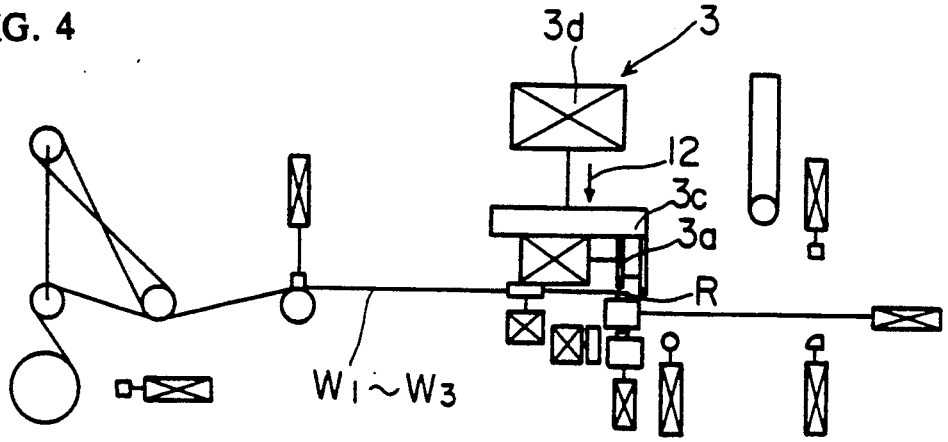
FIG. 4 is similar to FIG. 3, but shows the termination head actuated to terminate terminals to the right end of each of the insulated wires.

As shown in FIG. 4, the pneumatic piston-and-cylinder drive 3*d* of the termination unit 3 drives the right termination tool 3*a* to terminate the right connector pieces R1, R2 and R3 to the ends of the insulated wires W1, W2 and W3. As previously described, each insulated wire is pressed into a slot defined by the terminal of the connector piece and a pair of insulation displacement blades of the terminal thrust through the insulation of the insulated wire to contact the core conductor of the insulated wire as is known in the art.

Figure 5:
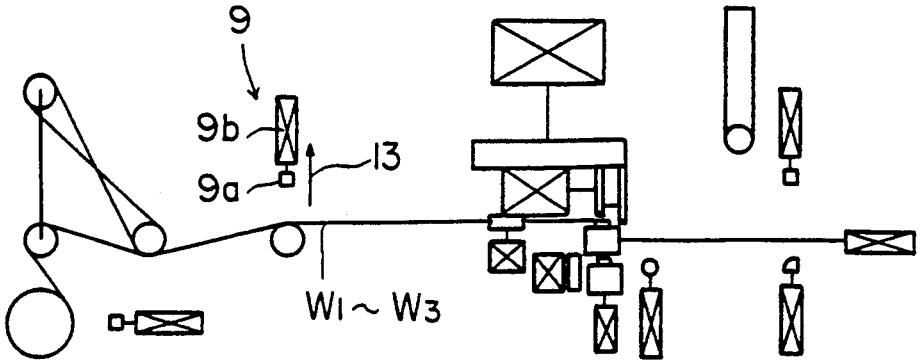
FIG. 5 is similar to FIG. 4, but shows the insulated wires unclamped on the wire-feeding side of the termination station.

Referring to FIG. 5, the pneumatic piston-and-cylinder drive 9*b* of the wire clamper 9 on the wire-feeding side raises all of the clamping heads 9*a* away from all of the insulated wires W1, W2 and W3 as indicated by arrow 13.

Figure 6:
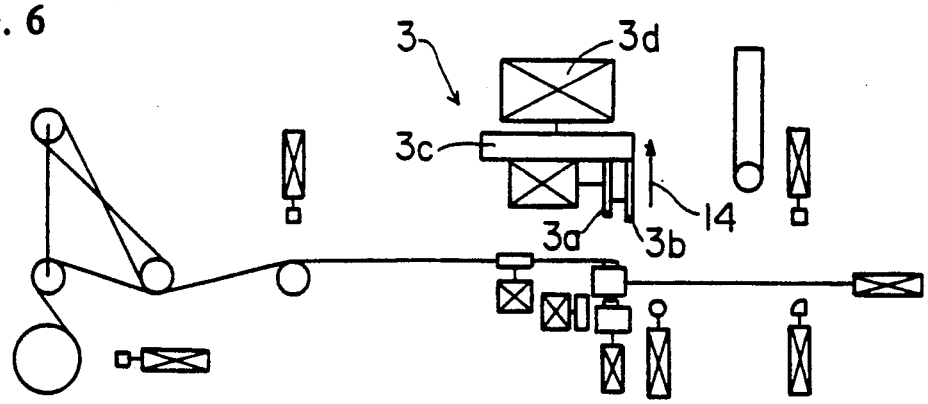
FIG. 6 is similar to FIG. 5, but shows the termination head raised to its initial raised position.

In FIG. 6 the pneumatic piston-and-cylinder drive 3*d* of the termination unit 3 raises the termination tools 3*a* and 3*b* to their initial raised position.

Figure 7:
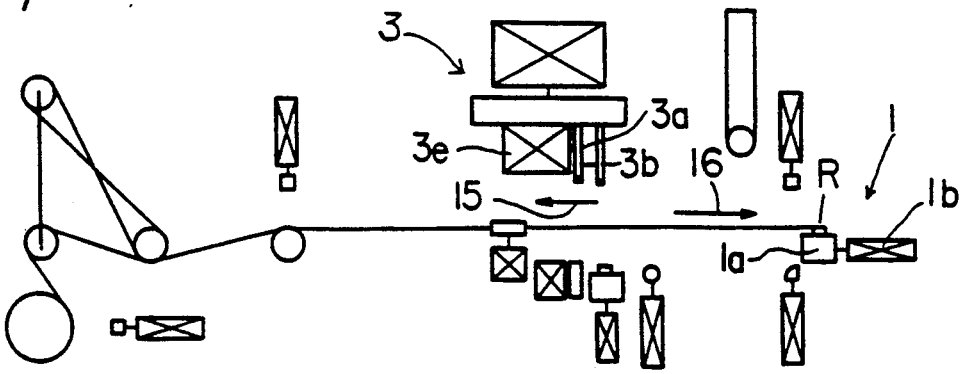
FIG. 7 is similar to FIG. 6, but shows the right connector piece transported to the initial position.

Referring to FIG. 7, the pneumatic piston-and-cylinder drive 3*e* of the termination unit 3 moves the termination tools 3*a* and 3*b* leftward as indicated by arrow 15 into position for subsequent termination of the left connector piece L to the insulated wires. In addition, the pneumatic piston-and-cylinder drive 1*b* of the transporting unit 1 drives the carriage 1*a* back to the initial starting position. Thus, the right ends of the insulated wires, W1, W2 and W3 together with the right connector pieces R1, R2 and R3 terminated thereto are brought to the initial starting position.

Figure 8:
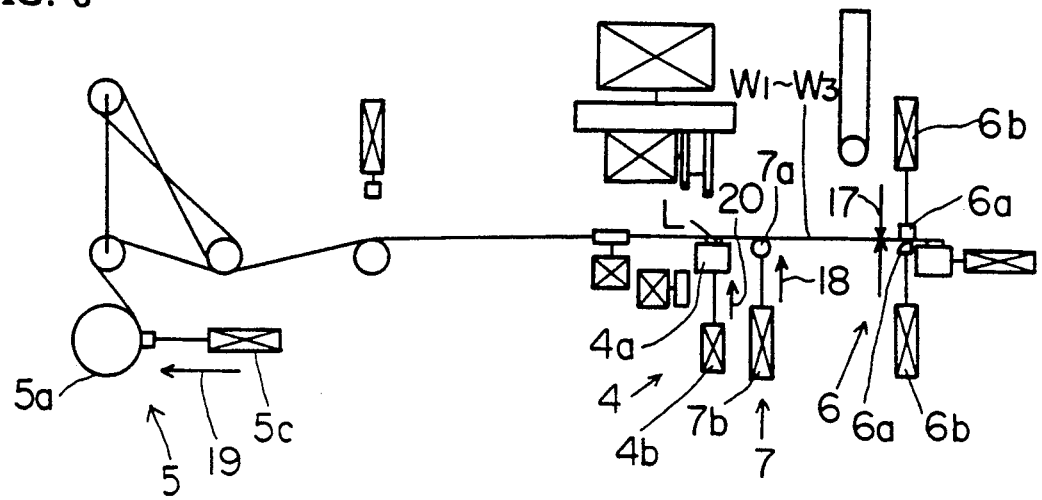
FIG. 8 is similar to FIG. 7, but shows the insulated wires clamped on the right side and at the same time, the "left" connector piece is raised.

FIG. 8 shows that the pneumatic piston-and-cylinder drives 6*b* of the wire clamper 6 moves the clamping heads 6*a* to clamp the insulated wires W1, W2 and W3 as indicated by arrows 17. The pneumatic piston-and-cylinder drive 7*b* of the auxiliary support unit 7 raises its support head 7*a* to support the insulated wires W1, W2 and W3 as indicated by arrow 18. As indicated by arrow 19, the wire-supplying reel brake 5*c* of the wire supplying unit 5 is actuated to prevent the feeding of the insulated wires to permit the subsequent measuring operations. At the same time, the pneumatic piston-and-cylinder drive 4*b* of the lift 4 raises the nest 4*a* containing left connector piece L to the termination position, as indicated by arrow 20.

Figure 9:
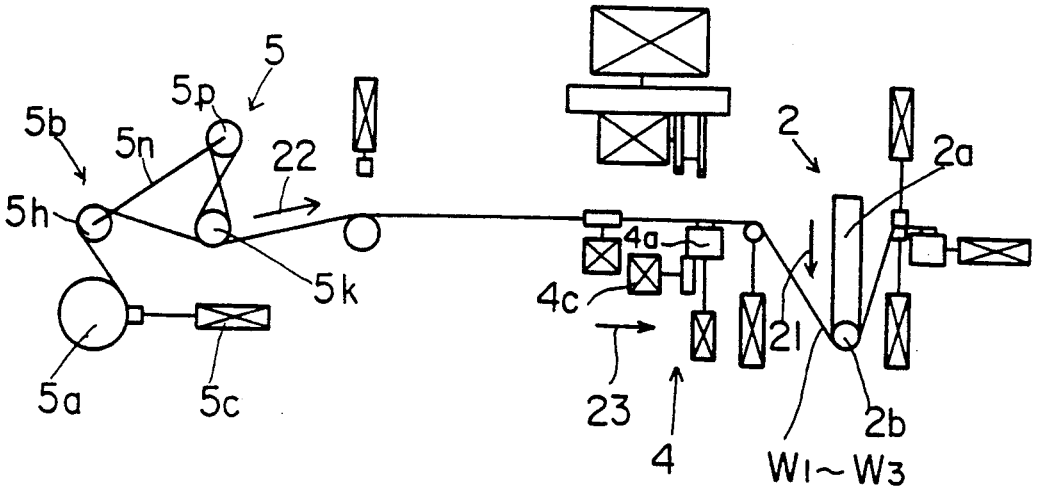
FIG. 9 is similar to FIG. 8 but shows the insulated wires being engaged by the looper mechanism to push them down at their intermediate points to the lowermost level to set the longest length of the insulated wires.

Referring next to FIG. 9, the beginning of the measuring operation can be seen. The roll support 2*a* of the wire measuring unit 2 is lowered down to its lowermost position so that the rolls 2*b* contact and push down the intermediate points of the insulated wires W1, W2 and W3 to the lowest level. Thus, all of the insulated wires W1, W2 and W3 are pulled so that the length of wire between the left and right connector pieces L equals the length of the longest wire A1 to be formed (See FIG. 20). The level setting and controlling of the roll support are effected with the aid of a robot using a servomotor. In FIG. 20, the intermediate lengths extending from the inside wall of the left connector piece L to the inside walls of the right connector pieces R1, R2 and R3 are indicated by A1, A2 and A3. In the descriptions referring to FIGS. 1 to 9 and subsequent drawings, however, for the sake of simplicity, the lengths A1, A2 and A3 of the insulated wires W1, W2 and W3 are given as the distances between the terminating positions at which the left and right connector pieces are terminated to the insulated wires.

When the insulated wires are pulled downstream by pushing them down with wire measuring unit 2, the movable arms 5*n* rotate towards lateral stationary arm 5*g* to release the length of insulated wires which is retained between the guide rolls 5*k* and 5*p*, as indicated by arrow 22. At such time, pistons-and-cylinders 5*c* clamp the reels 5*a* so that no insulated wires are supplied from the reels 5*a* to the geometric wire retainers 5*b*. The pneumatic piston-and-cylinder 4*c* holds the nest 4*a* of the lift 4 at the elevated position.

Figure 10:
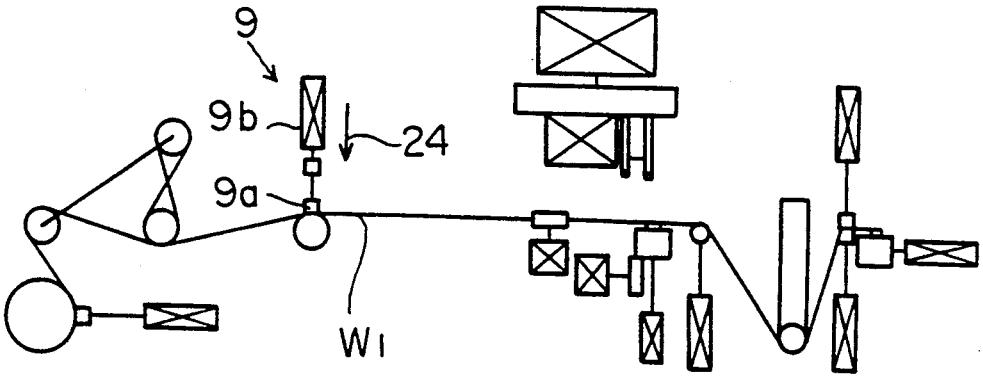
FIG. 10 is similar to FIG. 9, but shows certain of the insulated wires clamped on the wire-feeding side to maintain the longest length of the insulated wires.

Referring to FIG. 10, selected wires W1 of all of the insulated wires W1, W2 and W3 are clamped by corresponding wire clampers 9 as indicated by arrow 24. Specifically, only the pneumatic piston-and-cylinders allotted to the selected insulated wires W1 are selectively actuated to clamp these insulated wires with their clamping heads 9*a*.

Figure 11:
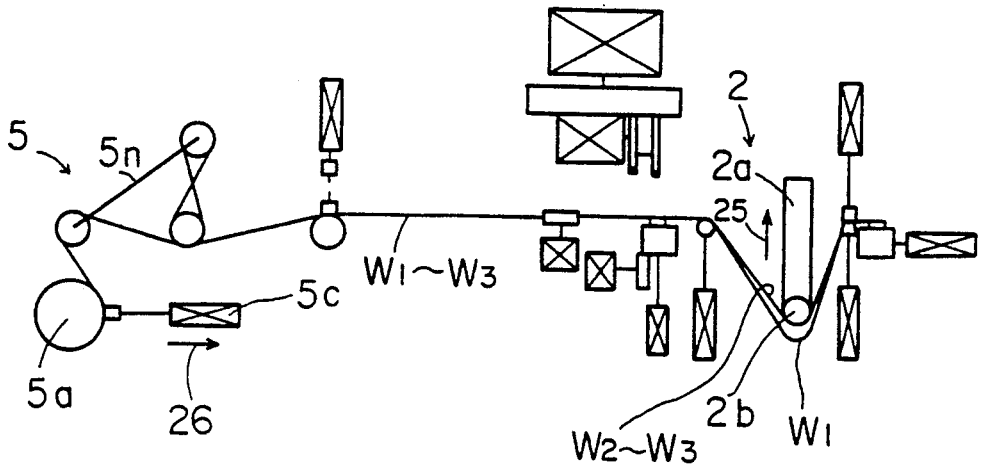
FIG. 11 is similar to FIG. 10, but shows the looper mechanism partially raised and some of the wire feed clamps released to determine the second longest length of the insulated wires.

In FIG. 11, the second longest lengths A2 of insulated wires W2 are measured. The roll support 2*a* is raised a predetermined distance to release the insulated wires. Because wires W2 and W3 are not clamped by wire clamps 9 and springs 5L are pulling the wires back upstream, the insulated wires W2 and W3 are pulled back by the spring-biased movable arms 5*n* of the geometric wire retainers 5 which permits these wires to follow the rising rolls 2*b* while the insulated wires W1 are clamped by selected wire clampers 9 to prevent the feeding-back of the insulated wires W1. Since the wire clamps 9 corresponding to wires W1 are isolating their respective wire retainers 5 from the wire measuring units 2, the piston-and-cylinders 5*c* corresponding to wires A1 are actuated to release the associated wire feeders 5 as indicated by arrow 26, thereby feeding predetermined lengths of insulated wires W1 to the geometric wire retainer as the spring-biased arms return to their initial raised position. At this point, insulated wires W2 and W3 have intermediate points positioned at the second lowest level and have a length corresponding to the length A2 between the opposite terminal connector pieces L and R2 in FIG. 20.

Figure 12:
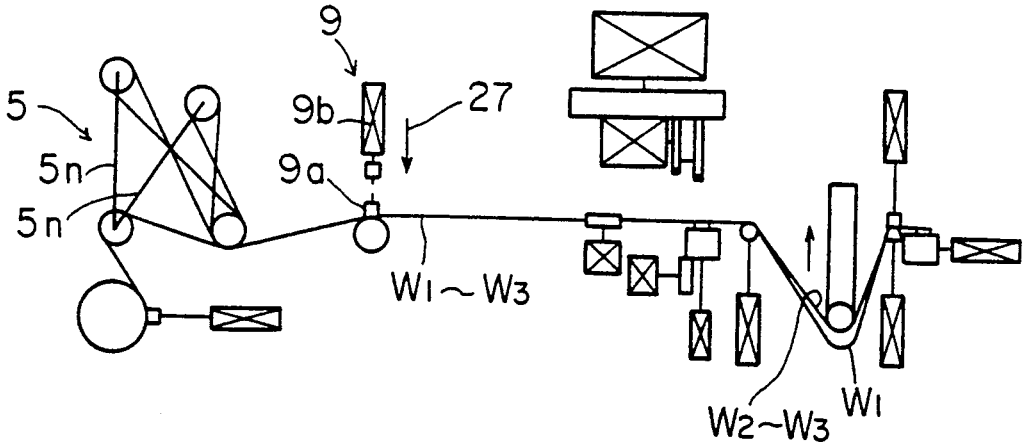
FIG. 12 is similar to FIG. 11, but shows certain of the insulated wires clamped on the wire-feeding side to maintain the second longest length of the insulated wires.

Referring to FIG. 12, the wire clampers 9 allotted to the insulated wires W2 are actuated to clamp these wires. The spring-biased arms 5*n* allotted to the insulated wires W1 return to their initial positions to retain required lengths of insulated wires W1 for the subsequent measuring operation of the next harness.

Figure 13:
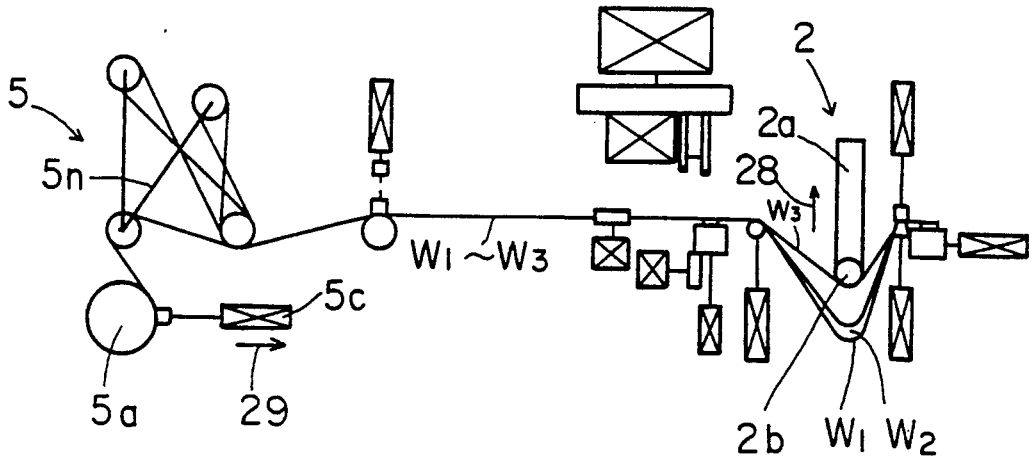
FIG. 13 is similar to FIG. 12, but shows the looper mechanism retracted further to the third lowermost level to determine the third longest length of insulated wires.

As shown in FIG. 13, the measuring of the third longest insulated wires W3 begins by raising the roll 2*b* a predetermined distance to the third lowest position. Since both the insulated wires W1 and W2 are clamped by the wire clampers 9 allotted to these wires, these insulated wires cannot be fed back. As a result, only wires W3 can be fed back upstream by the spring-biased movable arm 5*n* of the wire supply means 5 to permit wires W3 to follow roll 2*b* as it rises. By clamping wires W2 with wire clampers 9 and releasing their reels 5 by piston-and-cylinder 5*c*, wires W2 are fed to the geometric wire retainers 5 due to the spring bias of spring 5L. The distance the roll 2*b* is raised determines the length A3 of the third longest wire W3 as indicated in FIG. 20.

Figure 14:
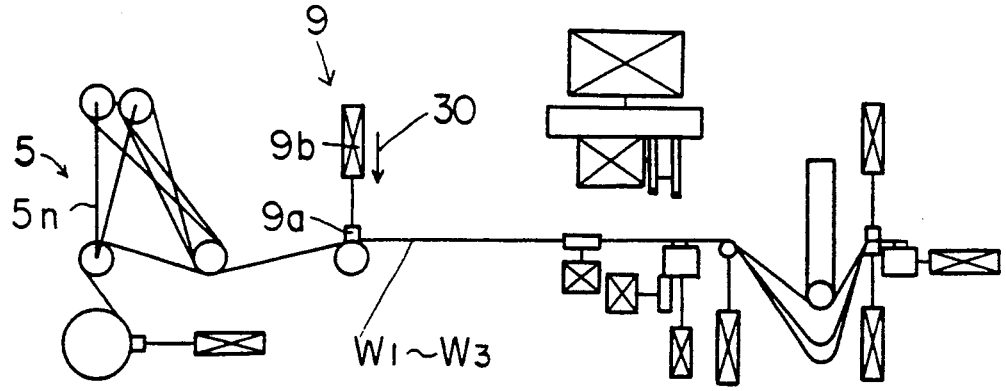
FIG. 14 is similar to FIG. 13, but shows certain of the insulated wires clamped on the wire-feeding side to maintain the third longest length of these insulated wires.

The clampers 9 pertaining to the insulated wires W3 then clamp wires W3 as indicated at 30 in FIG. 14. The spring-biased movable arms 5*n* allotted to the insulated wires W2 return to their raised position to permit the geometric wire retainer 5 to retain enough of insulated wires W2 to meet the requirements of the next measuring operation.

Figure 15:
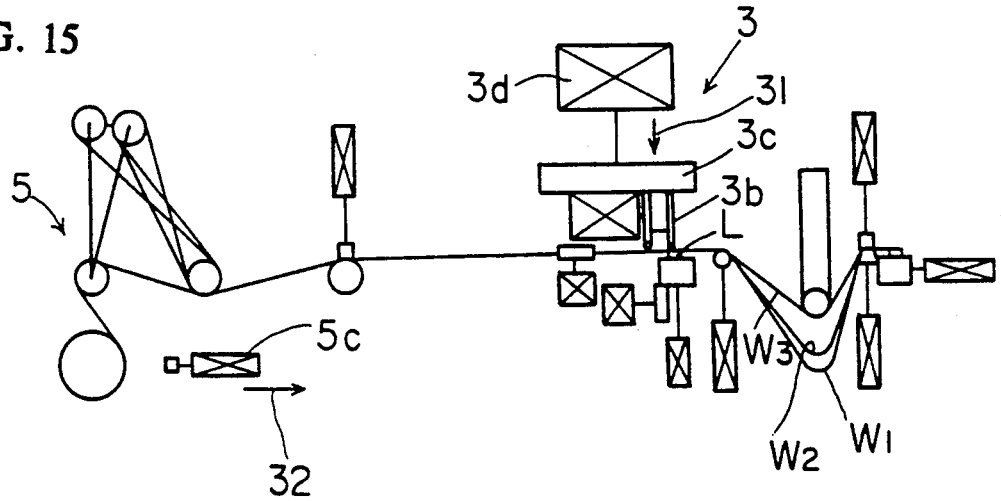
FIG. 15 is similar to FIG. 14, but shows the termination head lowered to terminate the terminals of the "left" connector piece to the left ends of the insulated wires.

Referring to FIG. 15, left connector pieces are terminated to the left ends of all of the insulated wires W1, W2 and W3 by the termination tool 3*b* of the termination unit 3. Prior to the termination operation, the left ends of all the insulated wires W1, W2 and W3 are cut by lowering the piston of the pneumatic piston-and-cylinder 3*d* as indicated by arrow 3 . The cutting and subsequent termination operations are effected by the lowering of the piston of the pneumatic piston-and-cylinder 3*d*. At that time, the pneumatic reel braking means 5*c* pertaining to the insulated wires W3 withdraws its piston (as indicated at 32) to permit the reels 5*a* to rotate freely which causes wires W3 to be fed to the geometric wire retainer 5*b* due to spring 5L.

Figure 16:
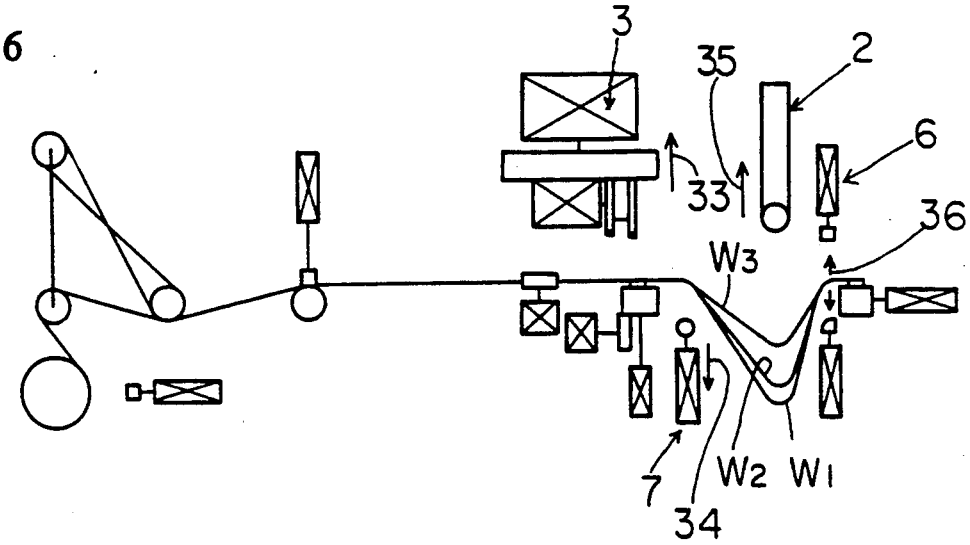
FIG. 16 is similar to FIG. 15, but shows the termination head is raised to the initial rased position and the harness unclamped.

Referring to FIG. 16, the terminating unit 3, the auxiliary support mechanism 7, the measuring unit 2, and the wire clamper 6 return to their initial positions as indicated by arrows 33, 34, 35 and 36, respectively.

Figure 17:
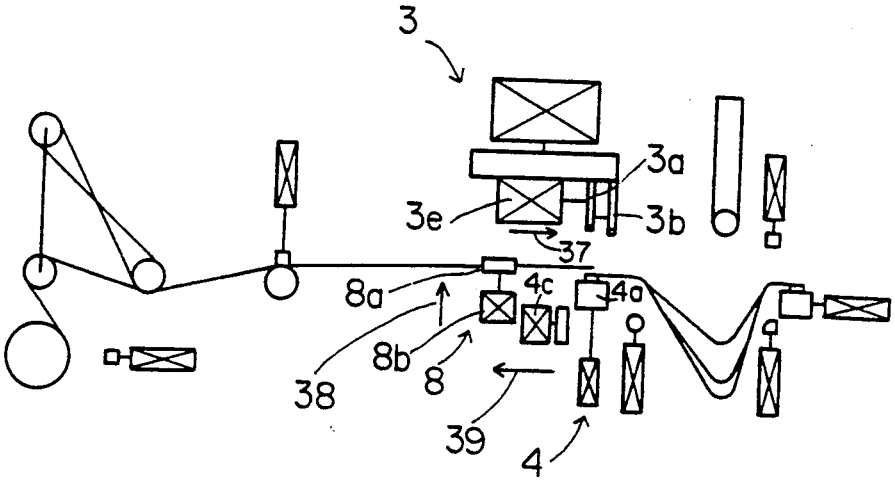
FIG. 17 is similar to FIG. 16, but shows the termination head and the left mechanism returned to its initial position.

Referring next to FIG. 17, the piston of the pneumatic piston-and-cylinder 3*e* of the termination unit 3 moves to the right as indicated by arrow 37 positioning the cutting and termination tools 3*a* and 3*b* in their initial positions. The left wire lift 8 raises its piston as indicated by arrow 38. Finally, the pneumatic support 4*c* associated with the left connector piece lift 4 withdraws its piston as indicated by arrow 39, thereby permitting the lowering of the nest 4*a*. Thus, the whole termination system is now in position for the subsequent measuring-and-termination operation.

Figure 18:
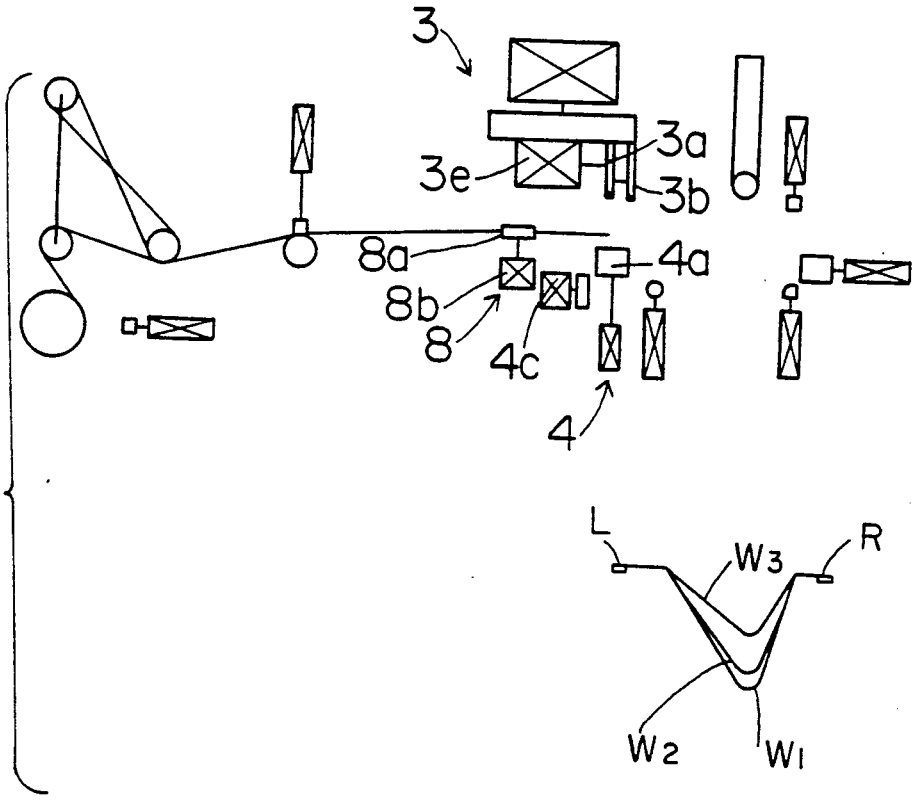
FIG. 18 is similar to FIG. 17, but shows the harness removed.

Referring to FIG. 18, a multi-circuit harness is completed. Such harness includes wires W1, W2 and W3 of required lengths A1, A2 and A3 having connector pieces L and R terminated to their opposite ends. As shown in FIG. 20, the multi-circuit harness comprises nine insulated wires having a two-circuit connector piece R2 terminated to the right ends of two insulated wires W2 of predetermined length A2, a four-circuit connector piece R3 terminated to the right ends of four insulated wires W3 of predetermined length A3, and a three-circuit connector piece R1 terminated to the right ends of three insulated wires W1 of predetermined length A1, and a nine-circuit connector piece L terminated to the right ends of all of the insulated wires W1, W2 and W3 of predetermined lengths A1, A2 and A3.

Figure 21:
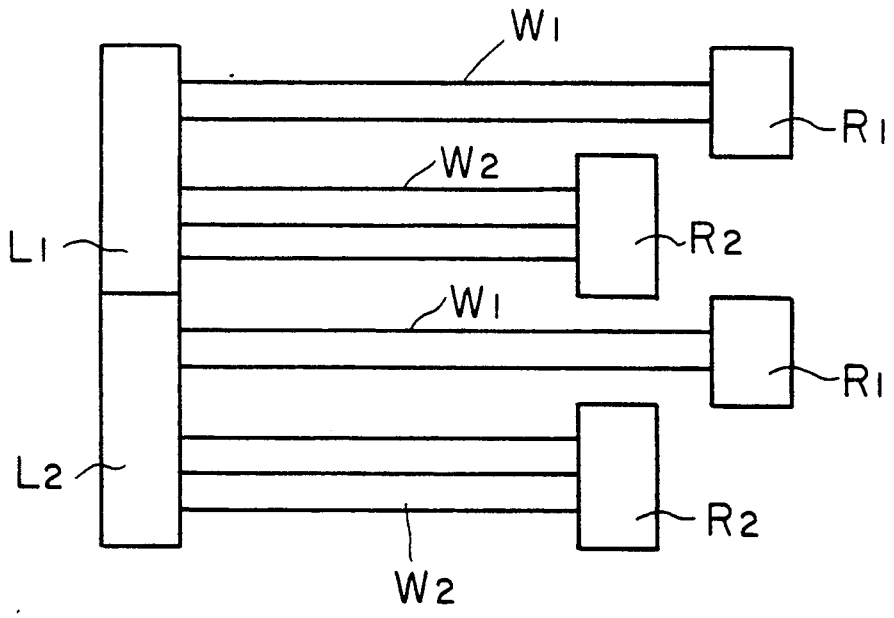
FIG. 21 shows schematically another example of harness.

As may be understood from the above, a measuring-and-termination system according to the present invention can be advantageously used to produce harnesses each having wires of different lengths as required. For instance, a single multi-circuit connector piece can be terminated to the left ends of a plurality of insulated wires whereas a similar multi-circuit connector piece can be terminated to the right ends of the insulated wires, different multi-circuit connector pieces can be terminated to the opposite ends of a plurality of insulated wires. FIG. 21 shows one example of a harness having two connector pieces L1 and L2 and four connector pieces R1 and R2 terminated to the opposite ends of ten insulated wires W1 and W2, with the longer and shorter ones being arranged somewhat alternately.

The harnesses shown have connector pieces terminated to opposite ends of the insulated wires. However, if desired, the left ends of the insulated wires may be left unterminated.

At the time of removing the harnesses from the measuring-and-termination system, every harness is tested by a current conduction checker to determine whether electric current can flow from one to the other end of the harness, and defective harnesses if found, are rejected.

Figure 19:
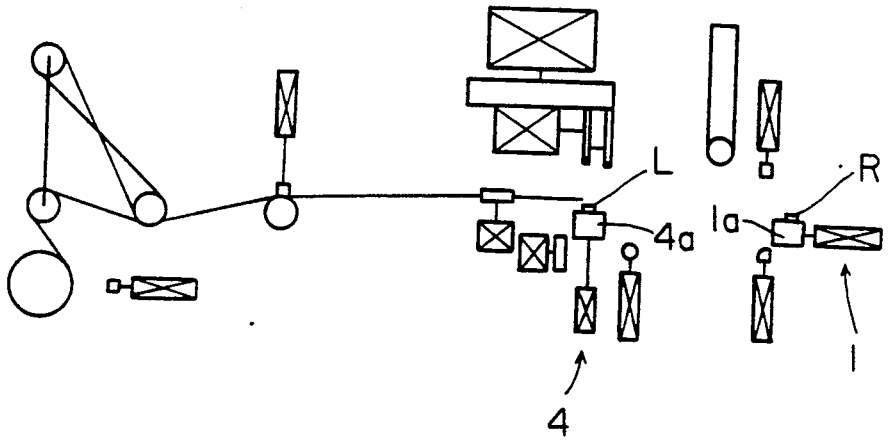
FIG. 19 is similar to FIG. 18, but shows apparatus in its initial position.

Referring to FIG. 19, right connector pieces R are supplied to the nest of the carriage la of the transporting unit for the subsequent termination operation, and left connector pieces L are supplied to the nest 4*a* of the connector piece lift 4. Then, the measuring-and-termination system returns to the position as shown in FIG. 1, starting the subsequent measuring-and-termination operation.

We claim:

1. An apparatus for making electrical harnesses, each harness including a first electrical connector (R) having terminals of the insulation displacement type, a plurality of wires (W1, W2, W3) terminated at one end to said first connector and said wires being of at least two different lengths, said apparatus including:

a wire feeding path;

a first station at which said first connector is loaded onto a first connector nest;

a second station located along said wire feeding path and at which said wires are terminated to said first connector;

a carriage (1) for moving said first connector nest between said first station and said second station;

a plurality of wire feeding reels (5*a*), each for supplying an individual wire along said wire feeding path;

insertion means (3) located at said second station for simultaneously displacing one end of each wire in a direction perpendicular to its axis and into one of said terminals to establish an electrical and mechanical connection therebetween;

a lead extension mechanism (2) positioned downstream of said second station for increasing the length of wire between the first connector terminated to said wires and said second station;

a plurality of wire take-up mechanisms (5*b*) located upstream of said second station and along said wire feeding path for providing an upstream biasing force on said wires, said plurality corresponding in number to said plurality of wires to be terminated; and a plurality of individually, selectively actuatable wire clamp mechanisms (9), each being located between one of said wire take-up mechanisms and said second station;

wherein the improvement comprises:

said lead extension mechanism comprising a looper assembly (2*a*, 2*b*) for engaging wires at said position while one end of each of said wires is fixed in said first connector and pulling the wires along said wire feeding path past said second station to increase the length of wire between said first connector and said second station; and each of said wire take-up mechanisms having an inlet and an outlet along said wire feeding path, a first section (5*g*) having first and second spaced apart pulleys (5*k*, 5*h*) rotatably mounted thereon and a second movable member (5*n*) mounted for pivotal movement relative to said first section, said second movable member having a third rotatable pulley (5*p*) mounted thereon and being pivotable between a first position (5*t*) at which said third rotatable pulley is located relatively proximal to said first section and a second position (5*m*) at which said third rotatable pulley is located relatively distal from said first section, each said wire take-up mechanism further including a spring member (5L) to bias said second member toward said second position in order to create a force biasing said wire in a direction upstream along said wire feeding path, whereby a wire enters said inlet, contacts said first pulley, is looped around said second pulley, is looped around said third pulley, contacts said second pulley and exits said wire take-up mechanism through said outlet.

2. The apparatus of claim 1 wherein said first station is located downstream of said second station along said wire feeding path, and said looper mechanism is located between said first and second stations.

3. The apparatus of claim 2 further including a first termination head (3*a*) moveable in a direction perpendicular to said wire feeding path for terminating the first connector to one end of said wires, and a second termination head (3*b*) moveable in a direction perpendicular to said wire feeding path for terminating a second connector to said wires, said first and second termination heads also being moveable in a direction generally parallel to said wire feeding path.

4. The apparatus of claim 2 further comprising a clamp mechanism (6) located between said looper assembly and said first station for clamping each wire terminated to said first electrical connector in order to reduce the strain on the termination of said wires to the terminals of said first connector upon engagement of said wires by said looper assembly.

5. The apparatus of claim 4 further including a support member (7) located between said second station and said looper assembly to guide said wires during engagement of said wires by said looper assembly.

6. The apparatus of claim 4 further including a wire lift mechanism (8) located between said second station and said individually, selectively actuatable wire clamp mechanisms to raise and lower the ends of said wires relative to said first connector nest when said nest is positioned at said second station.

7. The apparatus of claim 1 wherein each said wire feeding reel is operatively associated with a drive motor (5*d*) for feeding wire to one of said wire take-up mechanisms, and a brake assembly (5*g*, 5*r*, 5*s*) to start and stop feeding of said wire by said motor, each said brake assembly being controlled by movement of said second moveable member.

8. A method of manufacturing an electrical harness, each harness including a first electrical connector (R) having terminals of the insulation displacement type, a plurality of wires terminated at one end to said first connector and said wires being of at least two different lengths, said method comprising the steps of:

providing a wire feeding path;

providing a plurality of individual wires along said wire feeding path with one end of each being located at a second station positioned along said wire feeding path;

feeding said first electrical connector into a first connector nest (1*a*);

moving said first connector nest and said first connector to said second station;

simultaneously displacing one end of each wire in a direction perpendicular to its axis and into one of said terminals of said first connector to establish an electrical and mechanical connection therebetween;

moving said first connector and said wires terminated thereto to a first station;

securing each said wire upstream of said second station between a wire reel (5*a*) and a wire take-up mechanism (5*b*), said wire take-up mechanism being located downstream of said wire reel, each of said wire take-up mechanisms having an inlet and an outlet along said wire feeding path, a first section (5*g*) having first and second spaced apart pulleys (5*k*, 5*h*) rotatably mounted thereon and a second movable member (5*n*) mounted for pivotal movement relative to said first section, said second movable member having a third rotatable pulley (5*p*) mounted thereon and being pivotable between a first position (5*t*) at which said third rotatable pulley is located relatively proximal to said first section and a second position (5*m*) at which said third rotatable pulley is located relatively distal from said first section, each said wire take-up mechanism further including a spring member (5L) to bias said second member toward said second position in order to create a force biasing said wire in a direction upstream along said wire feeding path, whereby a wire enters said inlet, contacts said first pulley, is looped around said second pulley, is looped around said third pulley, contacts said second pulley and exits said wire take-up mechanism through said outlet;

moving a looper mechanism (2) downward from a non-engagement position above said wire feeding path to a full engagement position into and past the wire feeding path to engage said wires at a position intermediate said first connector and said second station to pull said wires past said second station to increase the length of wire between the first connector terminated to said wires and said second station, said pulling of said wires past said second station causing said second movable member to pivot from said second position to said first position and thus decrease the length of wire retained in said wire take-up mechanism between said second and third pulleys;

actuating certain of a plurality of individually, selectively actuatable wire clamp mechanisms (9), each being located between one of said wire take-up mechanisms and said second station;

moving said looper mechanism upward from said full engagement position toward said non-engagement position whereby said wires that are not engaged by said wire clamp mechanisms are drawn back upstream by said spring member of each said wire take-up mechanism so that said not engaged wires follow said looper mechanism upward and said second movable member pivots from said first position towards said second position and thus increases the length of wire retained in said wire take-up mechanism between said second and third pulleys;

repeating said steps of actuating said wire clamps and moving said looper upward until all of said wire clamps are actuated; and cutting the upstream ends of said wires at said second station to fabricate a harness having wires of at least two different lengths.

9. The method of claim 8 further including the step of simultaneously displacing one end of a plurality of said wires in a direction perpendicular to their axes and into respective insulation displacement type terminals of a second connector to establish an electrical and mechanical connection therebetween.

10. The method of claim 9 wherein the step of simultaneous displacement step of the wires of the first connector is carried out by a first termination head (3*a*) moveable in a direction perpendicular to said wire feeding path, said step of simultaneous displacement step of the wires of the second connector is carried out by a second termination head (3*b*) moveable in a direction perpendicular to said wire feeding path, and said first and second termination heads are moved in a direction generally parallel to said wire feeding path between said simultaneous displacement steps.

11. The method of claim 8 further including the steps of clamping each wire terminated to said first electrical connector between said looper assembly and said first station for in order to reduce the strain on the termination of said wires to the terminals of said first connector upon engagement of said wires by said looper assembly, supporting said wires between said second station and said looper assembly to guide said wires during engagement of said wires by said looper assembly.

* * * * *